United States Patent [19]

Ahlf

[11] 4,181,540

[45] Jan. 1, 1980

[54] METAL SURFACE TREATMENT METHOD

[75] Inventor: Robert E. Ahlf, Evansville, Ind.

[73] Assignee: Whirlpool Corporation, Benton Harbor, Mich.

[21] Appl. No.: 909,776

[22] Filed: May 26, 1978

[51] Int. Cl.[2] ..... C23F 7/10; C23F 7/26

[52] U.S. Cl. ..... 148/6.15 R; 148/6.2; 29/90 R

[58] Field of Search ..... 156/636, 645; 148/6.15 Z, 6.15 R, 6.2; 134/6, 7, 9; 29/90 R, 89.5

[56] References Cited

U.S. PATENT DOCUMENTS

| | | | |
|---|---|---|---|
| 1,109,670 | 9/1914 | Feidt | 148/6.15 R |
| 1,740,731 | 12/1929 | Gravell | 427/444 |
| 1,978,112 | 10/1934 | Malby | 148/6.2 |
| 2,036,740 | 4/1936 | Bengston | 148/6.2 |
| 2,221,968 | 11/1940 | Friedmann | 148/6.15 R |
| 2,266,379 | 12/1941 | Floyd | 148/6.15 R |
| 2,298,418 | 10/1942 | Roesner et al. | 148/6.2 |
| 2,453,429 | 11/1948 | Gorman | 156/645 X |
| 2,962,809 | 12/1960 | Short et al. | 29/445 |
| 3,075,279 | 1/1963 | Halter | 29/149.5 |

OTHER PUBLICATIONS

Deburring . . . The Common Cold of Industry, Production, Nov. 1977, p. 71.

Wiederholt, The Chemical Surface Treatment of Metals, Robert Draper Ltd., 1965, pp. 118, 120.

*Primary Examiner*—Ralph S. Kendall

*Attorney, Agent, or Firm*—Wegner, Stellman, McCord, Wiles & Wood

[57] ABSTRACT

A method of polishing or smoothing a metal surface includes the steps of (a) applying a solution of a compound capable of forming a friable, relatively impervious conversion coating on the surface, and (b) rubbing the conversion coating with a conforming surface while retaining the solution between the surfaces both to remove the conversion coating by abrasion and to expose the metal surface to the solution for further reaction, thereby repeatedly forming a conversion coating and breaking the coating away until the surface is smooth and polished.

15 Claims, No Drawings

METAL SURFACE TREATMENT METHOD

BACKGROUND OF THE INVENTION

1. Field of the Invention

This invention relates to methods of finishing a metal surface and, more specifically, this invention relates to a method of polishing or smoothing a metal surface by repeatedly forming and abrading away a conversion coating on the metal surface.

2. Description of the Prior Art

Many devices incorporating moving precision metal parts require that at least some surfaces of these parts, or the surfaces of stationary parts in proximity thereto, be true and as free of surface irregularities as possible. For example, the flat interior faces of front and rear heads for rotary compressors are in proximity to high speed rotors and must be free of even small irregularities.

In the past, metal surfaces have been smoothed by a variety of methods having various disadvantages. For example, a molded cast iron part may be coarsely ground to remove large surface irregularities and then ground with an abrasive of intermediate coarseness to reduce remaining irregularities to less than about 0.05 millimeters. Several successive precision grinding steps with abrasives of increasing degrees of fineness are then required to remove substantially all of the remaining irregularities. Even after precision grinding, however, fine grinding marks may remain on the ground surface and the immediate surface of the metal may be smeared or distorted in structure.

Precision grinding is expensive and may require the use of special lubricants or abrasive grits, as well as subsequent chemical treatment to deposit a conversion coating on the metal surface to make the part suitable for use as a bearing.

Some finished materials, such as aluminum, which experience seizing or galling when in rotation against a similar material, must be plated or otherwise coated with a material which renders the surface resistant to such seizing.

Even the finest grinding tool leaves minute grinding marks on a metal surface, rendering the surface relatively susceptible to wear. Surface grinding of materials having a lattice structure (such as sintered metal) results in distortion of the material. Further, metal grinding generates high surface temperatures which may be harmful to the surface so heated or cause the surface to distort during the grinding operation such that the finished surface is not true.

SUMMARY OF THE INVENTION

It is a principal object of the invention to provide a method of smoothing a metal surface whereby surface irregularities are removed without the use of a precision grinding operation. The method of the invention is advantageously used in smoothing the surfaces of metal parts to conform to each other or to a conforming surface, and provides a conversion coating on the surface of the part concurrently with the smoothing.

In practicing the invention, the metal surface is wetted with a solution of a compound which is known to rapidly oxidize the surface metal and to form a friable, relatively insoluble conversion coating thereon which is relatively impervious to the solution. A conforming surface is rubbed against the wetted metal surface so as to abrade and thereby remove the friable coating, thereby exposing freshly bared surface metal to the solution.

Continued rubbing of the surfaces, accompanied by rewetting of the metal surface, if necessary, results in repetitive formation and removal of a conversion coating on the metal surface and, therefore, gradual wearing away of surface irregularities. Upon removal of all irregularities and washing of the surface, a smooth conversion coating remains on the surface. Such a coating is highly desirable in many instances where the surface is to be used in a bearing application.

DETAILED DESCRIPTION OF THE INVENTION

According to the present invention, a partially machined or ground metal surface may be smoothed by a combined chemical and mechanical action wherein surface irregularities are repeatedly oxidized by an appropriate chemical solution and the resulting coating is removed by abrasion to allow further oxidation to take place.

Such oxidation is best carried out by use of a solution of a material capable of forming a conversion coating on the metal. The McGraw-Hill *Dictionary of Scientific and Technical Terms, p.* 326 (1974), defines "conversion coating" as "a metal-surface coating consisting of a compound of the base metal". The method of the present invention advantageously employs a solution capable of forming a conversion coating in repetitive oxidation and removal of surface irregularities as a substitute for precision grinding of the surface.

When an appropriate oxidizing solution is applied to an irregular metal surface, oxidation of the surface metal takes place, forming a compound of the metal, called a conversion coating, which adheres to the surface. The solution is chosen such that the resulting coating may be easily broken away from the surface by polishing, thereby exposing bare metal capable of further oxidation. If a surface containing irregularities is oxidized, abrasion of the surface will primarily wear away coating from irregularities projecting above the surface, leaving the coating between the irregularities relatively undisturbed.

Many solutions are known to be capable of forming metal conversion coatings. Each of these solutions may be utilized in the present invention, and reference to specific examples is not to be construed as unnecessarily limiting the invention. The most effective solutions are those which, when in contact with metal, form a friable coating on the metal which is relatively impervious to the solution. The impervious nature of such a coating prevents further contact of the solution with surface metal, thereby slowing the rate of surface oxidation.

Removal of the coating by abrasion allows the solution to again contact the metal surface, resulting in continued oxidation. Consequently, the degree of surface oxidation and consequent smoothing of the surface may be controlled by selection of the total period of contact of the solution with the surface, and by the frequency of abrasive removal of coating from the surface.

Typical of suitable conversion coating forming solutions are those normally used for coloring metals, such as those utilized in blackening or bluing metals. Solutions commonly used as a paint primer or those used for forming a lubricant-receptive coating on metal are also suitable. Specific examples of solutions which form conversion coatings are a manganese-iron phosphate complex (used on ferrous materials) and an aqueous alkali dichromate solution such as potassium or sodium dichromate (used on aluminum or zinc). Zinc or iron phosphates, known to be good paint primers, are further examples of conversion coating forming materials.

In the practice of the present invention, a metal surface having irregularities of up to 0.05 millimeters is thoroughly wetted with an aqueous solution of an appropriate conversion coating forming material. A conforming surface, which may be slightly abrasive, is then contacted with the wetted metal surface. The conforming surface may be of the same or a similar metal, ground glass, or other material having sufficient abrading characteristics to shear coating peaks from the metal surface. Alternatively, the metal surface may be contacted by a relatively resilient material such as a brush, cloth or sponge, preferably backed by a plate or other solid supporting surface.

The wetted metal surface and the conforming surface are rotated relative to one another, or are otherwise placed in relative movement so as to effect a wiping or rubbing action on the metal surface. This rubbing action results in the selective removal of coating and exposure of fresh surface metal to solution retained between the surfaces. This results in further oxidation and subsequent removal of coating. Additional solution may be applied, if required, to maintain a wetted metal surface.

Continued rubbing results in removal of virtually all surface irregularities to form an extremely smooth surface, flat or true to approximately 0.001 millimeters. The smooth conversion coating thus produced may enhance the corrosion and abrasion resistance properties of the metal and provide an excellent base for lubrication.

It has been found that surface irregularities of at least 0.05 millimeters may be easily removed by the above procedure in a relatively short time as compared to conventional grinding times, but larger irregularities can also be removed by the process. The above procedure generates very little heat and may be performed at substantially room temperature. Also, negligible surface distortion results from the use of the method of this invention. The method of the invention can be used on either hardened metal or soft metal with a negligible effect on the hardness.

Specific examples will better illustrate the practice of the invention.

EXAMPLE I

The cloth cover of a rotary metallurgical polishing lap was saturated with an aqueous solution of a manganese-iron phosphate complex. An iron casting with a flat face previously ground by an abrasive wheel of 180 grit was held stationary against the rotating cloth. Additional solution was periodically added to the cloth to maintain it in a saturated state.

After approximately 10 seconds of relative rotation, the casting was removed from the cloth and was observed to be highly polished. Unaided visual inspection revealed metallic crystals in the casting's surface, and microscopic examination of the surface revealed clearly defined graphite flakes. Conventional precision grinding of a surface to a comparable smoothness requires at least one minute, or six times the polishing time of the invention.

EXAMPLE II

Aluminum surfaces, when in mutual contact and in relative rotation, exhibit a tendency to seize or gall. However, smooth surfaces of aluminum oxide do not experience such seizing under light loads.

Two flat surfaces of aluminum rotary compressor end housings having minor surface irregularities were wetted with an aqueous potassium dichromate solution (20 grams per liter) maintained at a pH of between 8 and 10 by addition of sodium hydroxide. The dichromate solution was continuously applied between the aluminum surfaces as they were maintained in relative rotational contact. No galling or seizing was experienced. It is believed that aluminum oxide formed between the surface irregularities and was not abraded by the rubbing motion, but that aluminum oxide which formed on high spots was broken away by abrasion, exposing bare aluminum to the dichromate solution for further oxidation. Continued rubbing and wetting in this manner resulted in smooth, oxide-coated surfaces on each piece.

Each of the above examples was conducted at room temperature, and negligible temperature effects were noted.

It should be noted that the conversion coating formed in practicing the invention will in some cases be an oxide of the metal but, depending on the solution used, other compounds of the metal may be formed instead.

Having described the invention, the embodiments of the invention in which an exclusive property or privilege is claimed are defined as follows:

1. A process for smoothing a metal surface having irregularities comprising:
   (a) applying to said metal surface a solution capable of oxidizing the metal of said surface to form a friable conversion coating relatively impervious to and insoluble in said solution thereon;
   (b) abrading said coated metal surface with a conforming surface to remove said coating from portions of said metal surface and thereby re-expose said surface portions to said solution to reform said conversion coating at said exposed surface portions;
   (c) repeating said oxidation and abrasion steps until said coated metal surface is substantially smooth; and
   (d) washing said solution and removed material carried thereby from said coated surface.

2. The process of claim 1 wherein said solution is retained between said metal surface and said conforming surface so as to simultaneously effect said oxidation and said abrasion of said metal surface.

3. The process of claim 1 wherein said re-exposed metal surface portions comprise said surface irregularities.

4. A process for smoothing a ferrous surface having irregularities, comprising:
   (a) applying to said ferrous surface an aqueous solution of a manganese-iron phosphate complex so as to oxidize said ferrous surface to form a friable coating thereon which is relatively impervious to and insoluble in said solution;
   (b) abrading said coated ferrous surface with a conforming surface while retaining said solution between said surfaces to remove said coating from portions of said ferrous surface and re-expose said surface portions to said solution for further oxidation;

(c) repeating said abrasion and oxidation steps until said coated ferrous surface is substantially smooth; and (d) washing said solution and said removed material carried thereby from said coated ferrous surface.

5. A process for smoothing an aluminum surface having irregularities, comprising:

(a) applying to said aluminum surface an aqueous solution of an alkali dichromate to oxidize said aluminum to form a friable coating on said surface which is relatively impervious to and insoluble in said solution;

(b) lightly abrading said coated aluminum surface with a conforming surface while retaining said solution between said surfaces to remove said coating from portions of said aluminum surface and re-expose said surface portions to said solution for further oxidation;

(c) repeating said abrasion and oxidation steps until said coated aluminum surface is substantially smooth; and (d) washing said solution and said removed material carried thereby from said coated aluminum surface.

6. The process of claim 5 wherein said alkali dichromate comprises sodium dichromate.

7. The process of claim 5 wherein said alkali dichromate comprises potassium dichromate.

8. A process for smoothing a zinc surface having irregularities, comprising:

(a) applying to said zinc surface an aqueous solution of an alkali dichromate to oxidize said zinc to form a friable coating on said surface which is relatively impervious to and insoluble in said solution;

(b) lightly abrading said coated zinc surface with a conforming surface while retaining said solution between said surfaces to remove said coating from portions of said zinc surface and re-expose said surface portions to said solution for further oxidation;

(c) repeating said abrasion and oxidation steps until said coated zinc surface is substantially smooth; and (d) washing said solution and removed material carried thereby from said coated zinc surface.

9. The process of claim 8 wherein said alkali dichromate comprises sodium dichromate.

10. The process of claim 8 wherein said alkali dichromate comprises potassium dichromate.

11. A process for smoothing a metal part having surface irregularities of up to 0.05 millimeters, comprising:

(a) wetting the surface of said part with a solution selected to form a friable conversion coating at said surface, said coating being relatively impervious to said solution;

(b) repeatedly rubbing said wetted surface with a member which conforms to the desired surface of said part until said surface irregularities have been removed and a uniformly smooth conversion coating has been formed; and, (c) washing said part to remove said solution.

12. The process of claim 11 wherein said metal part comprises a cylinder head for a rotary compressor.

13. A process for smoothing mating surfaces of two metal parts to conform to each other, comprising:

(a) wetting said surfaces with a solution capable of oxidizing said surfaces to form a friable conversion coating at said surfaces, said coating being relatively impervious and insoluble in said solution;

(b) repeatedly rubbing said wetted surfaces together until surface irregularities are removed and said coated surfaces are rendered smooth; and (c) Washing said parts in a fluid which removes said solution while permitting said conversion coating to remain.

14. The process of claim 13 wherein said metal parts comprise mating gears.

15. A process for smoothing a metal surface having irregularities projecting therefrom, comprising:

(a) applying to said metal surface a solution capable of oxidizing the metal of said surface to form a friable conversion coating relatively impervious to and insoluble in said solution thereon;

(b) abrading said coated metal surface with a conforming surface to remove said coating from said irregularities and thereby re-expose said irregularities to said solution to reform said conversion coating at said exposed irregularities;

(c) repeating said oxidation and abrasion steps until said coated metal surface is substantially smooth; and (d) washing said solution and removed material carried thereby from said coated surface.

* * * * *